US012213566B2

(12) United States Patent
Nagel

(10) Patent No.: US 12,213,566 B2
(45) Date of Patent: Feb. 4, 2025

(54) SYSTEM AND METHOD FOR ATTACHING EMBROIDERED DESIGN ELEMENTS TO CLOTHING ARTICLES USING MAGNETISM

(71) Applicant: Stephen Roy Nagel, Las Vegas, NV (US)

(72) Inventor: Stephen Roy Nagel, Las Vegas, NV (US)

( * ) Notice: Subject to any disclaimer, the term of this patent is extended or adjusted under 35 U.S.C. 154(b) by 0 days.

(21) Appl. No.: 18/740,867

(22) Filed: Jun. 12, 2024

(65) Prior Publication Data

US 2024/0324734 A1 Oct. 3, 2024

Related U.S. Application Data

(63) Continuation-in-part of application No. 17/354,137, filed on Jun. 22, 2021, now abandoned.

(60) Provisional application No. 63/042,233, filed on Jun. 22, 2020.

(51) Int. Cl.
*A44C 3/00* (2006.01)

(52) U.S. Cl.
CPC ..... *A44C 3/001* (2013.01); *A44D 2203/00* (2013.01)

(58) Field of Classification Search
CPC ..... A44C 25/00; A44C 3/001; H01F 7/02; H01F 1/057; H01F 7/0252; A41F 1/002; A41D 27/08; A44D 2203/00; Y10T 24/32
See application file for complete search history.

(56) References Cited

U.S. PATENT DOCUMENTS

| | | | |
|---|---|---|---|
| 2,501,803 | A | 3/1950 | John |
| 5,369,899 | A | 12/1994 | Reeves |
| 6,519,779 | B1 | 2/2003 | Taguchi |
| 10,901,302 | B2 | 1/2021 | Wine et al. |
| 2005/0144704 | A1 | 7/2005 | Vitallo |
| 2006/0248629 | A1 | 11/2006 | Barkman et al. |
| 2007/0000181 | A1 | 1/2007 | Smushkovich |
| 2007/0119810 | A1 | 5/2007 | Boles |
| 2007/0151084 | A1 | 7/2007 | Long |
| 2007/0194187 | A1 | 8/2007 | Amron |
| 2010/0005693 | A1 | 1/2010 | Craycroft et al. |
| 2010/0275419 | A1 | 11/2010 | Millus |
| 2011/0219587 | A1 | 9/2011 | Nizan et al. |
| 2012/0005809 | A1 | 1/2012 | Johnson |
| 2012/0015120 | A1 | 1/2012 | Haegele et al. |
| 2013/0312160 | A1 | 11/2013 | Spencer |
| 2014/0370229 | A1 | 12/2014 | Leblanc |
| 2021/0177080 | A1 | 6/2021 | White et al. |

*Primary Examiner* — Robert Sandy
*Assistant Examiner* — Louis A Mercado
(74) *Attorney, Agent, or Firm* — Schmeiser, Olsen & Watts LLP

(57) ABSTRACT

A system and method for attaching design elements to an article of clothing are provided. The system includes an embroidered design element with a conductive layer coupled to a back surface of the embroidered design element. The system further includes a coupling member. In operation, the conductive layer is releasably and magnetically coupled to the coupling member with an article of clothing between the conductive layer and the coupling member.

7 Claims, 2 Drawing Sheets

SYSTEM AND METHOD FOR ATTACHING EMBROIDERED DESIGN ELEMENTS TO CLOTHING ARTICLES USING MAGNETISM

CROSS REFERENCE TO RELATED APPLICATION

This application is a continuation-in-part of U.S. patent application Ser. No. 17/354,137, filed Jun. 22, 2021, now abandoned, which claims priority to U.S. Provisional Patent Application Ser. No. 63/042,233, filed Jun. 22, 2020, the disclosures of which are hereby incorporated entirely herein by reference.

BACKGROUND OF THE INVENTION

Technical Field

This invention relates generally to a system and method for attaching design elements to an article of clothing and more particularly to a system and method for attaching design elements to clothing utilizing magnetism.

State of the Art

Typically hats and other articles of clothing (or garment) use embroidered designs (as an example but not limited to—i.e., could be other material including cloth, metal, plastic, leather-such materials hereinafter referred to as "embroidery/embroidered/patches") as a part of the hat or garment. The garment for example is usually directly embroidered on an automated machine with various threads of many colors that are used to create the final design or the patch. Further, many "patches" are made using the embroidery method and then attached to the hat or garment using traditional sewing, adhesive, Velcro or a pin may be used to attach the embroidered design.

Once the hat or garment is embroidered, the hat or garment is considered permanently decorated as the thread is permanently a part of the garment or has been permanently sewn or adhered to the hat or garment.

Further, some hats or garments do not lend themselves to the embroidery process such as cowboy hats or certain leather garments the owner is concerned that the item if done incorrectly would be permanently damaged and the replacement cost outweighs the direct embroidery process or the sewing or adhesion of a "patch".

Accordingly, there is a need for an improved system and method for attaching embroidered design elements to an article of clothing.

SUMMARY OF THE INVENTION

The present invention relates to a system and method for attaching design elements to clothing utilizing magnetism.

An embodiment includes a system for attaching design elements to an article of clothing, the system comprising: an embroidered design element; a conductive layer formed of a non-metal bendable material with a plurality of magnetically attractive balls coupled to the conductive layer, wherein: the conductive layer has a shape corresponding to a shape of the embroidered design element; and the conductive layer is coupled to a back surface of the embroidered design element; and a coupling member comprising a plurality of magnets coupled to a flexible substrate, wherein the flexible substrate is bendable between the plurality of magnets, and wherein the conductive layer is releasably and magnetically coupled to the coupling member with an article of clothing between the conductive layer and the coupling member.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

As discussed above, embodiments of the present invention relate to a system and method for attaching design elements to clothing utilizing magnetism.

Figure 1:
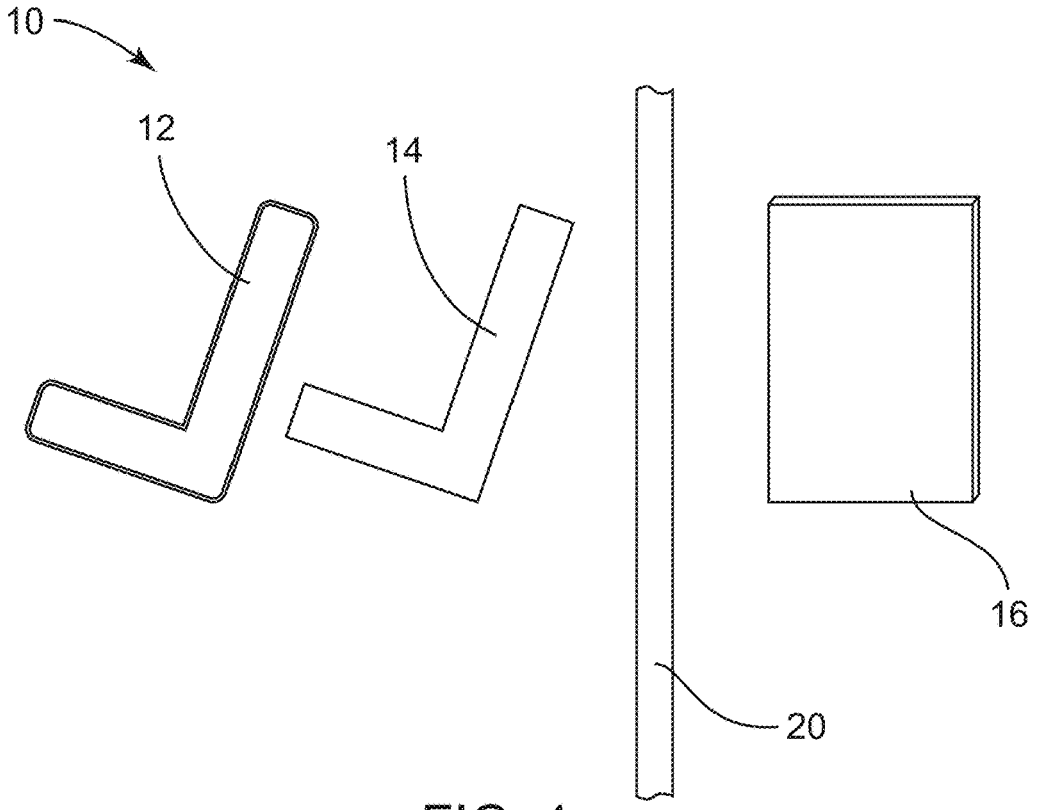
FIG. 1 is a perspective exploded view of a system for attaching an embroidered design element to a garment according to an embodiment.
Figure 2:
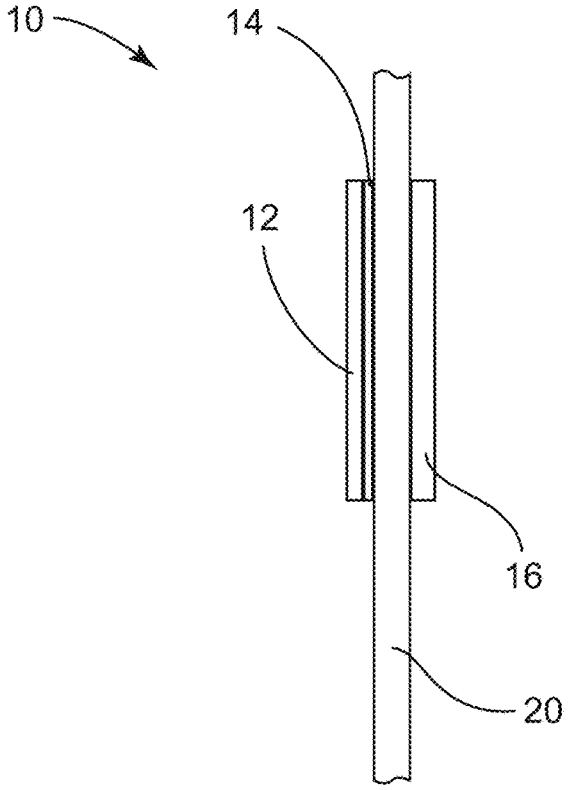
FIG. 2 is a side view of a system for attaching an embroidered design element to clothing according to an embodiment.

Referring to FIGS. 1 and 2, embodiments include an embroidery attachment system 10 that combines magnetism properties by attaching or otherwise creating a conductive metal layer 14 on the underside or backside of an embroidered design element 12 to place up against an outer surface of an article of clothing 20, and then utilizing a magnetic member 16 on an inner surface of the article of clothing 20 to hold the embroidered design element 12 to the article of clothing 20 by magnetic attraction between the conductive metal layer 14 and the magnetic member 16 through the article of clothing 20. It will be understood that while an embroidered design element 12 is discussed and shown, the design element 12 may be fabric or other woven material to form the design element 12.

The magnetic member 16 may include a magnet or magnets of sufficient magnetic polarity and strength to hold the embroidered design element 12 in place on the outer surface of the article of clothing 20. The article of clothing may be a hat, a shirt, pants, a garment of any type or the like and may be formed of fabric, cloth, leather, or the like as an example. This allows the article of clothing 20 to appear to be decorated using the embroidery method of decoration without permanently altering the actual material forming the article of clothing 20. Further it allows the temporary attaching, positioning, as well as easy removal and appearance of a logo or other type of embroidered design element 12 to a garment of any use, such as shirts, hats, dress, pants, work wear and the like.

An article of clothing 20, such as a cowboy hat is an excellent example of an item that is not using the embroidery methods for decoration, since the hat owner does not want to risk the damaging of the cowboy hat nor are there commercially marketed machines designed to embroider cowboy hats.

Figure 3A:
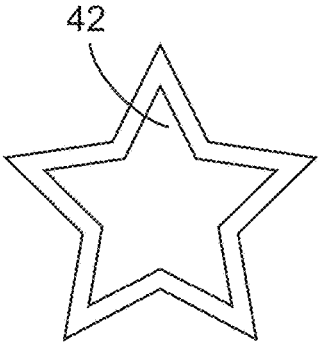
FIG. 3A is a front view of an embroidered design element according to an embodiment.
Figure 3B:
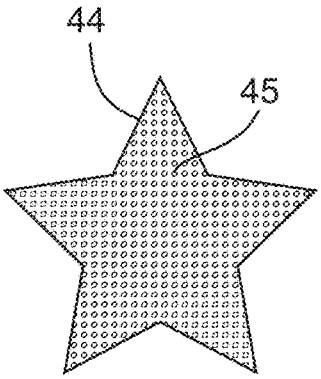
FIG. 3B is a rear view of an embroidered design element showing a backing layer according to an embodiment.
Figure 3C:
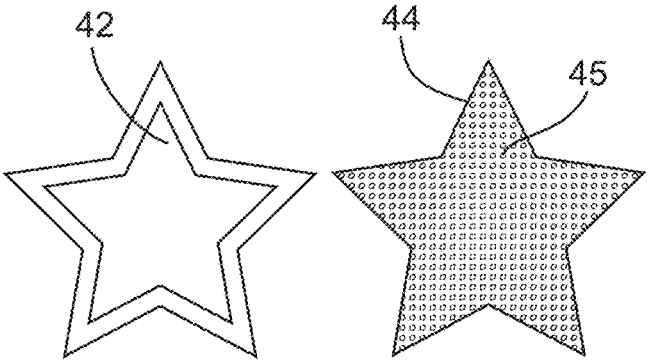
FIG. 3C is an exploded view of an embroidered design element according to an embodiment.

As shown in FIGS. 3A-4B, embodiments include an embroidery attachment system 10 that added magnetism properties to an embroidered design element 42. As shown in FIGS. 3A-3C, this may be accomplished by attaching or otherwise creating a conductive layer 44 on the underside or backside of the embroidered design element 42. The conducting layer 44 may be formed of a bendable material wherein a plurality of magnetically attractive balls 45 are coupled to or within the bendable material. The magnetically attractive balls 45 may be made of a ferrous material. The conductive layer 44 is bendable with the magnetically attractive balls 45 coupled to the bendable material because of the spaces between the magnetically attractive balls 45. Additionally, the conductive layer 44 is a cuttable material that can be cut to match the shape of the embroidered design element 42, an example of which is depicted in FIGS. 3A-3C as a star shape embroidered design element 42 and a corresponding star shape conductive layer 44. The embroidered design element 42 may also be formed of a bendable material. This allows the embroidered design element 42 with the conductive layer 44 coupled to the embroidered design element 42 to be bendable so that is may be coupled to an article of clothing 20 that is curved or has other non-planer characteristics, such as a hat for example.

Figure 4A:
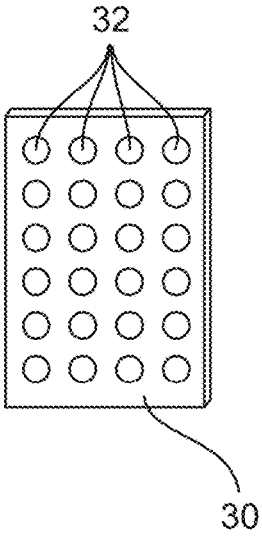
FIG. 4A is a perspective view of a coupling member according to an embodiment.

Referring specifically to FIG. 4A, the system 10 may include a coupling member 30 with one or more magnets 32 coupled to a substrate forming the coupling member 30. The coupling member 32, for example, and without limitation, may include a plurality of recesses formed in the coupling member 30 and the magnets 32 may be coupled within the plurality of recesses (i.e. foam panel with recesses that the magnets are coupled within and then film layer coupled to the foam panel to keep from removal). The coupling member 32 may also be coated with a film to block magnetism going out its non-used side to provide a level of safety to the user, if desired. It will be understood that the magnets 32 may be permanently attached to the coupling member 30, or in embodiments, the magnets 32 may be removably attached to the coupling member 30.

Figure 4B:
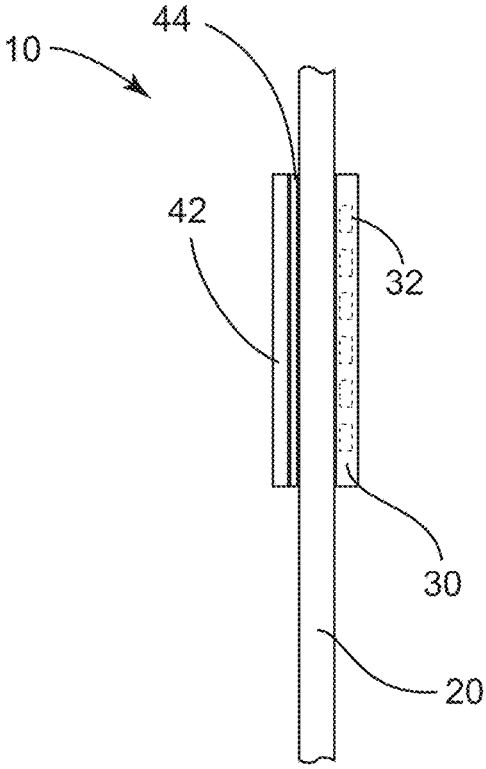
FIG. 4B is a side view of a system for attaching an embroidered design element to clothing according to an embodiment.

As shown in FIG. 4B, the embroidery attachment system 10 combines magnetism properties by placing the conductive layer 44 coupled to the underside or backside of the embroidered design element 42 up against an outer surface of an article of clothing 20, and then utilizing the coupling member 30 on an inner surface of the article of clothing 20 to hold the embroidered design element 42 to the article of clothing 20 by magnetic attraction between the conductive layer 44 and the coupling member 30 through the article of clothing 20. It will be understood that while an embroidered design element 42 is discussed and shown, the design element 12 may be fabric or other woven material to form the design element 42.

It will be understood that the utilization of a plurality of magnetically attractive balls 45 in the conductive layer 44, such as a plurality of metal balls 45, allows for the embroidered design element 42 to be magnetically attached to the coupling member 30 without the need to align magnets. This provides flexibility to remove one embroidered design element 42 and replace it with another design element 42 without needing to replace the coupling member 30. Not requiring the need for alignment of magnets also allows easy positioning of the magnets, so as to create the best fit of the embroidered part to conform to the hat, garment and the specific logo layout or form. Magnets can be of various sizes, shapes and attraction properties. Ferrous metal can be metal layers, metal laden polymer adhesives or metal parts made using shapes and sizes and properties to achieve the results intended by this invention.

Rare earth magnets (neodymium) may be the type of magnet in most cases, as they provide very strong magnetic properties as does ferrous alloy steels (e.g., industry 1010 tested) for the metal substrate as a "backer" for the embroidered part, however, other magnets are contemplated. Film steel metal alloy foils in a thickness in the range of from about 2 to about 10 millimeters may be used, however, any type of film or substrate may be used that is bendable and provides sufficient ferrous surface and magnetic potential for the magnets or rare earth magnets, such as neodymium, so as to have enough attraction to penetrate through the cloth, leather or garments structural material.

Embodiments allows the owner to use one hat or garment and change the design easily by incorporating magnets and a ferrous or other magnetic surface as described herein. Such metal/magnetic surface can also possibly be directly embroidered, eliminating the use of a receptive textile to then adhere or attach to the metal ferrous surface.

Conventional attaching requires a magnetic surface that is then slotted into a "pocket" or affixed to the hat/garment for example, and/or requires 2 magnets on each side for attraction with the one on the non-exposed side of the garment affixed or slotted to a space. The present invention does not require any prepositioning and is done at the user's choice.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A system for attaching design elements to an article of clothing, the system comprising:

an embroidered design element;

a conductive layer formed of a non-metal bendable material with a plurality of magnetically attractive balls coupled to the conductive layer, wherein:

the conductive layer has a shape corresponding to a shape of the embroidered design element; and the conductive layer is coupled to a back surface of the embroidered design element; and a coupling member comprising a plurality of magnets coupled to a flexible substrate, wherein the flexible substrate is bendable between the plurality of magnets, and wherein the conductive layer is releasably and magnetically coupled to the coupling member with an article of clothing between the conductive layer and the coupling member and does not require alignment of magnets.

2. The system of claim 1, wherein the bendable material of the conductive layer is a film.

3. The system of claim 2, wherein the film is bendable.

4. The system of claim 1, wherein the plurality of magnetically attractive balls are a plurality of metal balls coupled to the non-metal bendable material of the conductive layer.

5. The system of claim 1, wherein the plurality of magnets of the coupling member are rare earth magnets.

6. The system of claim 5, wherein the rare earth magnets are neodymium.

7. The system of claim 1, wherein the coupling member is removably attached to an inner surface of the article of clothing.

* * * * *